United States Patent [19]

Mitsuhashi et al.

[11] Patent Number: 4,599,824

[45] Date of Patent: Jul. 15, 1986

[54] DEVICE FOR AUTOMATICALLY OPENING AND CLOSING HINGED DOOR

[75] Inventors: Wataru Mitsuhashi, Kobe; Kouji Kaminaka, Akashi; Kaname Kotani, Kobe, all of Japan

[73] Assignee: Nippon Air Brake Co., Ltd., Kobe, Japan

[21] Appl. No.: 731,284

[22] Filed: May 7, 1985

[30] Foreign Application Priority Data

Nov. 26, 1984 [JP] Japan ..... 59-249981

[51] Int. Cl.[4] ..... E05B 65/10; E05F 15/12

[52] U.S. Cl. ..... 49/141; 49/334

[58] Field of Search ..... 49/141, 334, 335, 336

[56] References Cited

U.S. PATENT DOCUMENTS

| | | | |
|---|---|---|---|
| 3,064,964 | 11/1962 | Carlson | 49/141 X |
| 3,369,323 | 2/1968 | Millard et al. | 49/334 X |
| 4,045,914 | 9/1977 | Catlett | 49/334 |
| 4,220,051 | 9/1980 | Catlett | 49/334 X |
| 4,333,270 | 6/1982 | Catlett | 49/336 |

*Primary Examiner*—Philip C. Kannan

*Attorney, Agent, or Firm*—Oblon, Fisher, Spivak, McClelland & Maier

[57] ABSTRACT

A device for automatically opening and closing a hinged door includes a motor having a drive shaft, a speed reducer, an operating shaft adapted to be connected to the hinged door and operatively coupled through the speed reducer to the drive shaft, a chain sprocket fixed to the operating shaft, a chain trained in mesh around the chain sprocket, a first rod having an end coupled to an end of the chain, with a first fixed to an opposite end of the first rod, a second rod having an end coupled to an opposite end of the chain, with a second flange fixed to an opposite end of the second rod, a first tubular body in which the first rod is axially movably disposed, a first spring disposed around the first rod within the first tubular body for normally urging the first flange in a direction away from the chain sprocket, a second tubular body in which the second rod is axially movably disposed, and a second spring disposed around the second rod within the second tubular body for normally urging the second flange in a direction away from the chain sprocket. One of the first and second springs has a smaller spring force.

5 Claims, 8 Drawing Figures

DEVICE FOR AUTOMATICALLY OPENING AND CLOSING HINGED DOOR

BACKGROUND OF THE INVENTION

1. Field of the Invention

The present invention relates to a device for automaticaly opening and closing a hinged door, the device having an ability to allow the door to be manually openable in emergency.

2. Description of the Prior Art

Automatic hinged doors are installed in entrances and exits of many buildings. As is well known, a device for automatically opening and closing such a hinged door has a mechanism both for allowing the door to be manually opened in a direction opposite to the direction in which the door is normally opened for permitting occupants to escape in case of emergency such as a fire or an earthquake, and for automatically returning the door to the closed position under the resiliency of a spring which has stored energy when the door is opened, after the occupants have passed through the entrance or exit.

One representative prior art of the above mechanism is disclosed in U.S. Pat. No. 4,333,270. The disclosed mechanism will hereinafter be described with reference to FIG. 6 of the accompanying drawings.

The device for automatically opening and closing the automatic hinged door is installed above an entrance or exit of a building in which the hinged door is mounted. The device has a frame body 15 accommodating a support frame 40 in which there is disposed a rack 42 movable horizontally (as shown in FIG. 6) by a guide rail 41. The rack 42 is held in mesh with a pinion 43 fixed to an operating shaft 3 which can be driven to rotate about its own axis by a motor, not shown. A tubular body 44 has one end coupled by a first sleeve 45 to an end of the support frame 40. A rod 49 is disposed in the tubular body 44 and threaded at one end in the rack 42 for movement therewith. A second sleeve 46 and a spring seat flange 47 are fitted over one end portion of the rod 49. A hollow rod 48 has an end fixedly fitted over an opposite end of the rod 49. The hollow rod 48 is also fitted over an end portion of a smaller rod 51 which extends into the tubular body 44, the smaller rod 51 having an opposite end portion secured to a cover 50 mounted on an opposite end of the tubular body 44. A spring seat flange 54 is fitted over the hollow rod 48 and is held in abutment against a nut 52 threaded over the end of the hollow rod 48 remote from the rod 49 and a third sleeve 53 with one end thereof held in intimate contact with the cover 50. A spring 55 is disposed around the rod 49 and the hollow rod 48 and extends axially between the spring seat flanges 47, 54 for normally urging the spring seat flanges 47, 54 to move them away from each other.

Operation of the prior device thus constructed will be described below. When a power supply switch for the motor is turned on in response to an OPEN command from a control unit (not shown), a door shaft (not shown) coupled directly or via a transmission device to the operating shaft 3 is rotated with the operating shaft 3 in the direction of the arrow A. At the same time, the pinion 43 fixed to the operating shaft 3 is also rotated in the same direction. The rack 42 meshing with the pinion 43 and the rod 49 coupled to the rack 42 are moved to the left in the direction of the arrow A'. Since the spring seat flange 54 fixed to the rod 49 is moved toward the other spring seat flange 47 on the movement of the rod 49, the spring 55 disposed around the rod 49 between the spring seat flanges 45, 54 is compressed. When the motor power supply switch is turned off in response to a CLOSE command from the control unit, the motor is made free to rotate, and the rod 49 is moved to the right in the direction of the arrow B' under the repulsive force of the compressed spring 55. The pinion 43 meshing with the rack 42 and the operating shaft 3 are rotated in the direction of the arrow B for thereby automatically closing the hinged door.

In case of emergency such as a fire or an earthquake, the hinged door should manually be pushed open by rotating the operating shaft 3 in the direction of the arrow B which is opposite to the direction of the arrow A. As the operating shaft 3 rotates in the direction of the arrow B, the rack 42 is moved to the right in the direction of the arrow B', so that the rod 49 connected to the rack 42 is also moved to the right. As a consequence, the spring seat flanges 47, 54 are moved relatively toward each other to compress the spring 55. When the hinged door is released of a manual push after the occupants have passed through the entrance or exit, the rod 49 is moved to the left in the direction of the arrow A' under the force of the spring 55. The pinion 43 in mesh with the rack 42 and the operating shaft 3 are rotated in the direction of the arrow B to close the hinged door automatically.

Automatic hinged doors are generally installed in entrances and exits of buildings and rooms. Any hinged door installed in an entrance or exit of a building is subjected to an external wind pressure. The device for automatically opening and closing such hinged door has to incorporate a spring having a relatively strong spring force in order to prevent the door from vibrating due to the wind pressure. The force with which the hinged door is swung open by the motor while compressing the spring is equal to the force with which the hinged door is manually pushed open while compressing the spring. As a result, in an emergency, the hinged door has to be opened with a manual force strong enough to overcome the relatively strong spring force. However, it is preferable from the standpoint of safety that the manual force required to open the door in emergency be as small as possible, requiring a smaller spring force. This requirement is contradictory to the spring force which should be large enough to withstand wind pressures to which the hinged door is normally subjected.

SUMMARY OF THE INVENTION

With the conventional drawbacks in view, it is an object of the present invention to provide a device for automatically opening and closing a hinged door, the device being capable of freely selecting, dependent on the place of installation of the hinged door, one of a spring force acting when the door is normally opened and closed and a spring force acting when the door is opened and closed in case of emergency.

According to the present invention, there is provided a device for automatically opening and closing a hinged door, comprising a motor having a drive shaft, a speed reducer, an operating shaft adapted to be connected to the hinged door and operatively coupled through the speed reducer to the drive shaft, a chain sprocket fixed to the operating shaft, a chain trained in mesh around the chain sprocket, a first rod having an end coupled to an end of the chain, with a first flange fixed to an opposite end of the first rod, a second rod having an end coupled to an opposite end of the chain, with a second flange fixed to an opposite end of the second rod, a first tubular body in which the first rod is axially movably disposed, a first spring disposed around the first rod within the first tubular body for normally urging the first flange in a direction away from the chain sprocket, a second tubular body in which the second rod is axially movably disposed, and a second spring disposed around the second rod within the second tubular body for normally urging the second flange in a direction away from the chain sprocket.

When a power supply switch for the motor is turned on, rotation of the drive shaft of the motor is reduced in speed and increased in torque and then transmitted to the operating shaft. On rotation of the operating shaft, the hinged door is opened and the chain sprocket fixed to the operating shaft is simultaneously rotated about its own axis. The chain disposed in mesh around the chain sprocket is moved with the rotation of the chain sprocket, thus pulling the first rod toward the chain sprocket. The first spring which urges the first flange away from the chain sprocket is now compressed against its resiliency. When the power supply switch for the motor is turned off, the chain is moved away from the chain sprocket by the first flange and the first rod under the repulsive force of the compressed first spring. The operating shaft fixed to the chain sprocket is also rotated with the chain sprocket, thereby opening the hinged door in one direction.

When the hinged door is manually opened in emergency in a direction opposite to the direction in which the hinged door is opened by the motor, the operating shaft is rotated about its own axis in an opposite direction, enabling the chain meshing with the chain sprocket to pull the second rod toward the chain sprocket. The second spring which urges the second flange away from the chain sprocket is now compressed against its resiliency. By selecting the spring force of the second spring to be smaller than the spring force of the first spring, the hinged door can manually be opened with a smaller force than the force with which the hinged door is opened by the motor. When one of the first and second rods is pulled by the chain toward the chain sprocket, the other rod is held at rest, and hence no force is imposed by the spring around the other rod. The end of the chain coupled to the other rod is slackened between the other rod and the chain sprocket.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
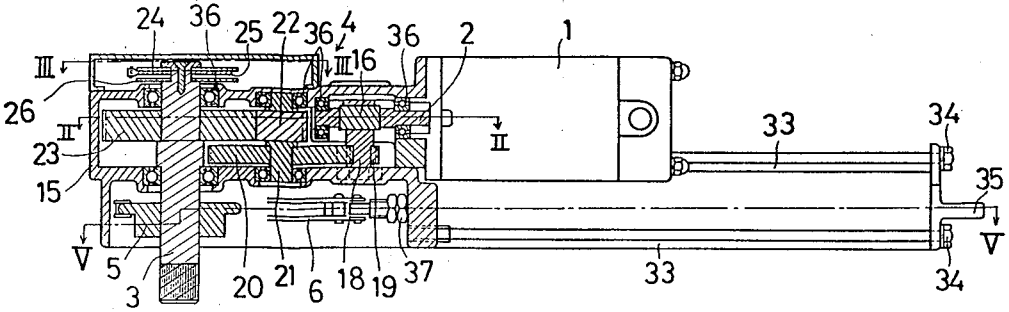
FIG. 1 is a longitudinal cross-sectional view of a device for automatically opening and closing a hinged door according to the present invention.
Figure 2:
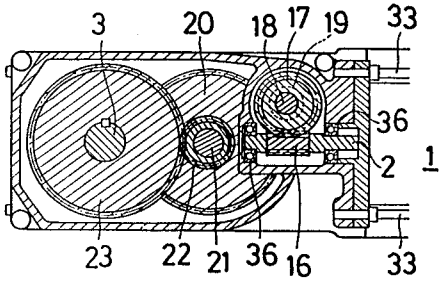
FIG. 2 is a cross-sectional view taken along line II—II of FIG. 1.
Figure 3:
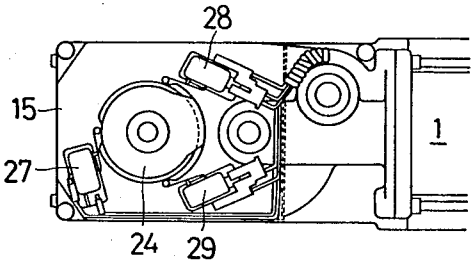
FIG. 3 is a cross-sectional view taken along line III—III of FIG. 1.
Figure 4:
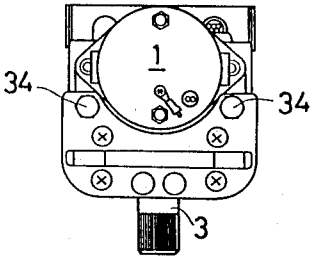
FIG. 4 is a right-hand side elevational view of the device shown in FIG. 1.
Figure 5A:
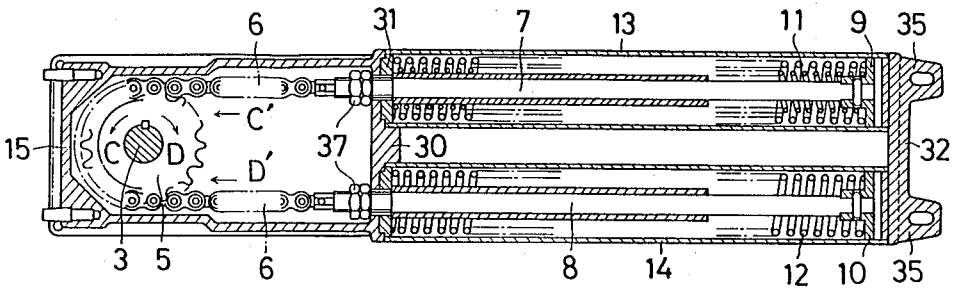
FIG. 5A is a cross-sectional view taken along line V—V of FIG. 1, showing the parts positioned when the hinged door is closed.

As illustrated in FIGS. 1 and 2, a device for automatically opening and closing a hinged door according to the present invention is primarily composed of a motor 1, a speed reducer 4 for reducing the speed of rotation of a drive shaft 2 of the motor 1 and transmitting rotative power from the drive shaft 2 to an operating shaft 3, a chain 6 trained in mesh around a chain sprocket 5 fixed to the operating shaft 3, a first rod 7 (FIGS. 5A through 5C) connected to an end of the chain 6, a second rod 8 connected to an opposite end of the chain 6, first and second flanges 9, 10 fixed to ends of the first and second rods 7, 8, respectively, remote from the chain 6, first and second springs 11, 12 disposed around the first and second rods 7, 8, respectively, for normally urging the first and second flanges 9, 10 in a direction away from the chain sprocket 5, a first tubular body 13 housing therein the first rod 7, the first flange 9, and the first spring 11, and a second tubular body 14 housing therein the second rod 8, the second flange 10, and the second spring 12 and extending parallel to the first tubular body 14.

The speed reducer 4 is mounted in a frame body 15 to which the motor 1 is attached. The speed reducer 4 comprises a worm 16 fixed to the drive shaft 2 of the motor 1, a worm gear 17 meshing with the worm 16, a first gear 19 fixed to a shaft 18 of the worm gear 17, a second gear 20 meshing with the first gear 19, a third gear 22 fixed to a shaft 21 of the second gear 20, and a fourth gear 23 meshing with the third gear 22 and fixed to the operating shaft 3. Rotation of the drive shaft 2 of the motor is thus reduced in speed and increased in torque by the meshing arrangement of the worm 16, the worm gear 17, the first gear 19, the second gear 20, the third gear 22, and the fourth gear 23, and then transmitted to the operating shaft 3. The operating shaft 3 is coupled to a door shaft, not shown, directly through a coupling or indirectly through a transmission mechanism. With ordinary automatic door systems, the hinged door will be opened to an extent which allows people to pass when the operating shaft 3 is turned through 90° about its own axis.

To an end of the operating shaft 3 remote from the chain sprocket 5, there are fixed first, second, and third cams 24, 25, 26 having peripheral surfaces against which first, second, and third switches 27, 28, 29 are operatively held. The peripheral surfaces of the first, second, and third cams 24, 25, 26 have recesses and projections such that the first, second, and third switches 27, 28, 29 are turned on or off as the operating shaft 3 rotates for controlling an electromagnetic brake near terminal ends of opening and closing strokes of the hinged door. The above control arrangement is of a known construction employed in the prior art referred to above.

The first and second tubular bodies 13, 14 can be attached to the frame body 15 by providing the frame body 15 with a cover member 30 (FIG. 5A) in its opening, having holes for passage of the first and second rods 7, 8 therethrough, fitting in the cover member 30 inserts 31, 31 disposed in open ends of the first and second tubular bodies 13, 14 closely to the chain sprocket 5, and fastening a closure member 32 to the frame body 15 with bolts 33 and nuts 34 in covering relation to open ends of the first and second tubular bodies 13, 14 remotely from the chain sprocket 5. The closure member 32 has attachment legs 35, 35 for being secured to a frame of the entrance or exit of the building in which the hinged door is installed. Bearings 36 are disposed between the drive shaft 2, the operating shaft 3, the gear shafts 18, 21, and the frame body 15. Adjustment nuts 37 are threaded over the first and second rods 7, 8 closely to the chain sprocket 5. The adjustment nuts 37 serve as stoppers for limiting the intervals of movement of the first and second rods 7, 8 and to axially move the first and second rods 7, 8 axially, upon fastening or loosening, to rotate the chain 6 for thereby adjusting the closed position of the hinged door.

Figure 5B:
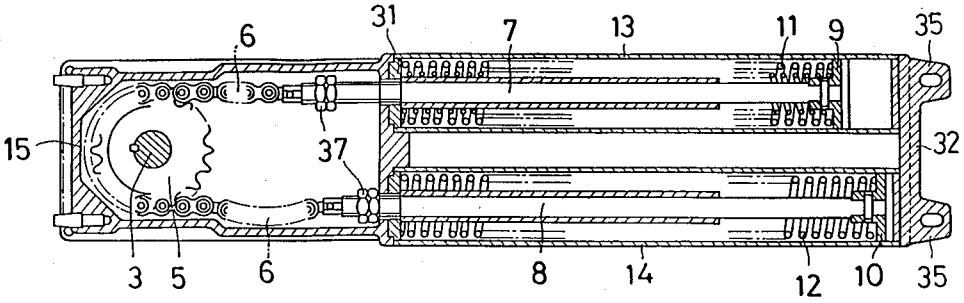
FIG. 5B is a cross-sectional view taken along line V—V of FIG. 1, showing the parts positioned when the hinged door is opened by a motor.

Operation of the device of the foregoing construction is as follows: Normal door opening and closing operation will first be described. When a power supply switch for the motor 1 is closed to rotate the drive shaft 2 thereof as a person approaches the entrance or exit, rotation with an increased torque is transmitted via the speed reducer 4 to the operating shaft 3. As the operating shaft 3 rotates, the hinged door is turned through about 90° about the door shaft coupled to the operating shaft 3. At the same time, the chain 6 trained around the chain sprocket 5 is moved in the direction of the arrow C′ toward the chain sprocket 5 as the latter rotates in the direction of the arrow C. The first rod 7 fixed to the end of the chain 6 is also moved to compress the first spring 11 (FIG. 5B). Since no force at all is exerted on the other end of the chain 6, it is slackened when the first spring 11 is under compression. When the chain 6 returns to its original condition, it is kept taut without imposing any substantial force on the second rod 8.

When the power supply switch is turned off after the person has passed through the entrance or exit, the motor 1 is rendered free to rotate. The first rod 7 and the chain 6 are now moved in a direction opposite to the direction of the arrow C′ away from the chain sprocket 5 under the repulsive force of the compressed first spring 11. The operating shaft 3 is also rotated about its own axis back to the position shown in FIG. 5A.

Figure 5C:
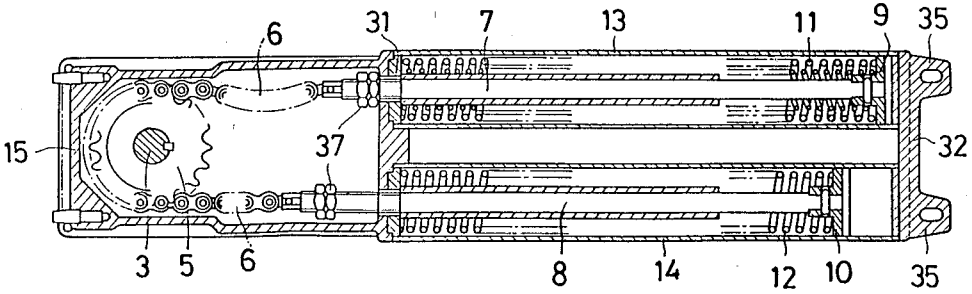
FIG. 5C is a cross-sectional view taken along line V—V of FIG. 1, showing the parts positioned when the hinged door is manually opened.
Figure 6:
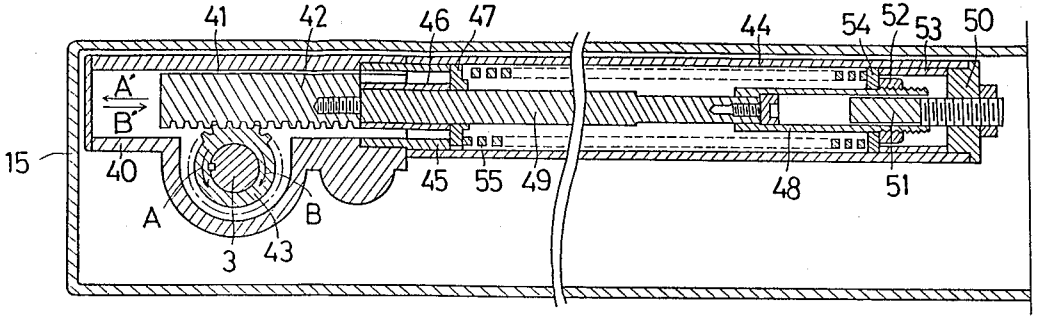
Fig 6 PRIOR ART
FIG. 6 is a fragmentary cross-sectional view of a conventional device.

When people rush to the door in emergency and manually opens the door in an opposite direction, the second switch 28 is actuated at the time the hinged door is swung ajar. The power supply circuit for the motor 1 is now broken, and the operating shaft 3 and the chain sprocket 5 are rotated in the direction of the arrow D for thereby pulling the chain 6 and the second rod 8 in the direction of the arrow D′. At this time, the second spring 12 is compressed (FIG. 5C). By selecting the spring force of the second spring 12 to be smaller than the spring force of the first spring 11, the hinged door can be swung open with a manual force smaller than the force with which the door is opened by the motor 1. Under this condition, no force at all acts on the end of the chain 6 connected to the first rod 7, so that the end of the chain 6 is slackened when the second spring 12 is compressed. When the chain 6 returns to its original condition, it is kept taut without imposing any substantial force on the first rod 7.

When the hinged door is released of a manual push after the people have passed through the entrance or exit, the second rod 8 and the chain 6 are moved in a direction opposite to the direction of the arrow D′ away from the chain sprocket 5 under the repulsive force of the compressed second spring 12. The operating shaft 3 is therefore rotated to the original position shown in FIG. 5A.

During the foregoing operation, the first, second, and third switches 27, 28, 29 and the first, second, and third cams 24, 25, 26 are operatively combined to issue control commands to the motor 1 for smoothly opening and closing the hinged door. Since such controlled operation is of the same as that of the conventional construction described above, it will not be described.

Although the spring force of the second spring 12 may be relatively small, it is required to be large enough to close the hinged door.

With the arrangement of the device according to the present invention, therefore, the hinged door can be opened by the motor under normal condition and with a manual force in emergency while compressing the springs having different spring forces, respectively. Therefore, it is possible to select and use the spring having the spring force which meets the location of the hinged door. More specifically, where the hinged door is opened by the motor under ordinary conditions, the spring with the stronger spring force can be employed for producing a rotative force with which the hinged door can be closed automatically. Such spring is effective in preventing the hinged door from vibrating due to external wind pressure. In the event of manually opening the hinged door in case of emergency, the spring with the smaller spring force is used for producing a rotative force with which to close the hinged door automatically. Thus, the hinged door can be manually opened with a smaller force.

Although a certain preferred embodiment has been shown and described, it should be understood that many changes and modifications may be made therein without departing from the scope of the appended claims.

What is claimed is:

1. A device for automatically opening and closing a hinged door, comprising:

(a) a motor having a drive shaft;

(b) a speed reducer;

(c) an operating shaft adapted to be connected to the hinged door and operatively coupled through said speed reducer to said drive shaft;

(d) a chain sprocket fixed to said operating shaft;

(e) a chain trained in mesh around said chain sprocket;

(f) a first rod having an end coupled to an end of said chain, with a first flange fixed to an opposite end of said first rod;

(g) a second rod having an end coupled to an opposite end of said chain, with a second flange fixed to an opposite end of said second rod;

(h) a first tubular body in which said first rod is axially movably disposed;

(i) a first spring disposed around said first rod within said first tubular body for normally urging said first flange in a direction away from said chain sprocket;

(j) a second tubular body in which said second rod is axially movably disposed; and (k) a second spring disposed around said second rod within said second tubular body for normally urging said second flange in a direction away from said chain sprocket.

2. A device according to claim 1, wherein one of said first and second springs has a spring force smaller than the spring force of the other of the first and second springs.

3. A device according to claim 1, wherein said first and second tubular bodies extend parallel to each other.

4. A device according to claim 1, including a frame body in which said speed reducer, said operating shaft, said chain sprocket, and said chain are housed.

5. A device according to claim 4, wherein said ends of said first and second rods are coupled to said chain within said frame body and support stoppers engageable with said frame body.

* * * * *